US008336263B2

(12) United States Patent
Schultz et al.

(10) Patent No.: US 8,336,263 B2
(45) Date of Patent: Dec. 25, 2012

(54) MOMENT CONNECTION FOR CONCRETE CONTAINER WALL AND FOOTING

(75) Inventors: Gary R. Schultz, Voorheesville, NY (US); Andrew S. Bell, Slingerlands, NY (US)

(73) Assignee: Aquattica Pools & Water Parks, Inc., Voorheesville, NY (US)

( * ) Notice: Subject to any disclaimer, the term of this patent is extended or adjusted under 35 U.S.C. 154(b) by 60 days.

(21) Appl. No.: 12/912,097

(22) Filed: Oct. 26, 2010

(65) Prior Publication Data

US 2012/0096634 A1 Apr. 26, 2012

(51) Int. Cl.
*E02D 27/00* (2006.01)

(52) U.S. Cl. ..... 52/169.8; 52/169.7; 52/247; 52/293.3; 52/295; 52/298; 52/741.12

(58) Field of Classification Search ..... 52/169.7, 52/169.8, 258, 247, 293.3, 294, 295, 298, 52/741.12–741.14, 283; 4/506
See application file for complete search history.

(56) References Cited

U.S. PATENT DOCUMENTS

| | | | | | |
|---|---|---|---|---|---|
| 1,908,332 | A | | 5/1933 | Eichelman et al. | |
| 1,964,870 | A | * | 7/1934 | Chappell | 264/32 |
| 2,140,978 | A | | 12/1938 | Beeby | |
| 3,226,935 | A | * | 1/1966 | Schneller | 405/287 |
| 3,407,552 | A | * | 10/1968 | Cassidy | 52/169.5 |
| 3,487,599 | A | * | 1/1970 | Jansen | 52/169.7 |
| 3,561,017 | A | | 2/1971 | Holland | |
| 3,824,751 | A | * | 7/1974 | Shelander | 52/223.3 |
| 4,015,384 | A | | 4/1977 | Barry | |
| 4,106,246 | A | * | 8/1978 | LaFountaine | 52/169.7 |
| 4,142,339 | A | * | 3/1979 | Crowley | 52/223.3 |
| 4,164,933 | A | | 8/1979 | Alosi | |
| 4,324,009 | A | | 4/1982 | Hornsby | |
| 4,483,025 | A | | 11/1984 | Meredith | |
| 4,569,173 | A | * | 2/1986 | Hultquist | 52/293.1 |
| 4,843,658 | A | * | 7/1989 | Hodak | 4/506 |
| 5,590,497 | A | * | 1/1997 | Moore | 52/223.3 |
| 5,774,906 | A | | 7/1998 | Ellis et al. | |
| 6,244,005 | B1 | * | 6/2001 | Wallin | 52/293.1 |
| 6,591,565 | B2 | * | 7/2003 | Morello | 52/275 |
| 6,854,223 | B1 | | 2/2005 | Holland | |
| 7,001,110 | B2 | * | 2/2006 | Lockwood | 405/284 |
| 7,062,885 | B1 | * | 6/2006 | Dickenson, Jr. | 52/293.3 |
| 7,302,777 | B1 | * | 12/2007 | Sugranes | 52/169.7 |

FOREIGN PATENT DOCUMENTS

| | | | | |
|---|---|---|---|---|
| DE | 3441344 | A1 | * | 5/1986 |
| FR | 2 566 447 | A1 | | 12/1985 |
| FR | 2 707 321 | A1 | | 1/1995 |
| FR | 2 614 052 | A1 | | 10/1998 |
| JP | 57-158436 | A | | 9/1982 |
| JP | 04330119 | A | * | 11/1992 |
| JP | 05017957 | A | * | 1/1993 |
| JP | 10-146818 | A | | 6/1998 |
| JP | 2003-293604 | A | | 10/2003 |

* cited by examiner

*Primary Examiner* — Brian Glessner
*Assistant Examiner* — Adriana Figueroa
(74) *Attorney, Agent, or Firm* — David E. Rook; Hoffman Warnick LLC

(57) ABSTRACT

A concrete container including a concrete footing including a shear key; a concrete wall inserted in the shear key; a plurality of footing reinforcing members inserted in the concrete footing on a support side of the shear key and extending above the concrete footing; a plurality of wall reinforcing members inserted in the concrete wall on a support side of the concrete wall and extending diagonally towards the concrete footing; a poured concrete moment connection substantially covering the plurality of footing reinforcing members extending from the pre-cast concrete footing and the plurality of wall reinforcing members extending from the wall.

20 Claims, 4 Drawing Sheets

MOMENT CONNECTION FOR CONCRETE CONTAINER WALL AND FOOTING

FIELD OF THE INVENTION

The present invention relates generally to concrete containers, and more specifically relates to a moment connection for a concrete container wall and footing.

BACKGROUND OF THE INVENTION

Concrete containers may be used for holding various quantities of liquid and solid materials. Concrete containers may be constructed above or below ground surface or in various intermediate positions relative to the ground surface. Pressure may be exerted on the walls of concrete containers either internally from material being contained or externally when the concrete container is constructed below a surface, e.g. by the weight of soil. Depending upon where the concrete container is constructed and the nature and quantity of material being held by the concrete container, a differential pressure may be pushing the walls in or out.

Concrete containers may be formed by pouring concrete in place, e.g. constructing a form, pouring the concrete into the form, and removing the form. For example, a footing may be poured in place and, after the footing is cured, walls may be poured in place.

Concrete containers may include concrete pools. Concrete pools may be constructed below the ground surface, above the ground surface, or at various intermediate heights in relation to the ground surface. Typically a concrete pool contains water that needs to be circulated and filtered. Accordingly, a concrete pool may include a gutter system to move the water in and out of the concrete pool. Movement of the water may include moving through filtration systems and chemical systems. Further, for sealing the concrete pool and to provide comfort and safety for users, a concrete pool may include a liner. A concrete pool may include a deck for user access to the concrete pool.

The use of pre-cast concrete components, e.g. walls and footings, is limited in the construction of concrete containers due to external and/or internal pressure pushing the wall away from the footing thereby creating aesthetic and functional displacements to the concrete container.

SUMMARY OF THE INVENTION

A first aspect of the invention provides a concrete container, comprising: a concrete footing including a shear key; a concrete wall inserted in the shear key; a plurality of footing reinforcing members inserted in the concrete footing on a support side of the shear key and extending above the concrete footing; a plurality of wall reinforcing members inserted in the concrete wall on a support side of the concrete wall and extending diagonally towards the concrete footing; a concrete moment connection substantially covering the plurality of footing reinforcing members extending from the concrete footing and the plurality of wall reinforcing members extending from the wall.

A second aspect of the invention provides a concrete pool, comprising: a concrete footing including a shear key; a concrete wall inserted in the shear key; a plurality of footing reinforcing members inserted in the concrete footing on a support side of the shear key and extending above the concrete footing; a plurality of wall reinforcing members inserted in the concrete wall on a support side of the concrete wall and extending diagonally towards the concrete footing; a concrete moment connection substantially covering the plurality of footing reinforcing members extending from the concrete footing and the plurality of wall reinforcing members extending from the wall.

A third aspect of the invention provides a method for installing a concrete pool, the method comprising: installing a concrete footing on a surface, wherein the preparing includes: shaping a shear key in the footing on a side opposite the surface; and casting-in-place a plurality of footing reinforcing members in the footing on a support side of the shear key and extending above the concrete footing; installing a concrete wall, wherein a bottom surface of the concrete wall is inserted in the shear key and wherein the concrete wall includes a plurality of wall reinforcing members inserted in the concrete wall on a support side of the concrete wall and extending diagonally towards the concrete footing; leveling the concrete wall; plumbing the concrete wall; substantially filling the shear key with a grout; casting a concrete moment connection substantially covering the plurality of footing reinforcing members extending from the concrete footing and the plurality of wall reinforcing members extending from the concrete wall; and casting at least three concrete corner closures, wherein each concrete corner closure connects two adjacent concrete walls.

These and other aspects, advantages and salient features of the invention will become apparent from the following detailed description, which, when taken in conjunction with the annexed drawings, where like parts are designated by like reference characters throughout the drawings, disclose embodiments of the invention.

BRIEF DESCRIPTION OF THE DRAWINGS

These and other features of this invention will be more readily understood from the following detailed description of the various aspects of the invention taken in conjunction with the accompanying drawings in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
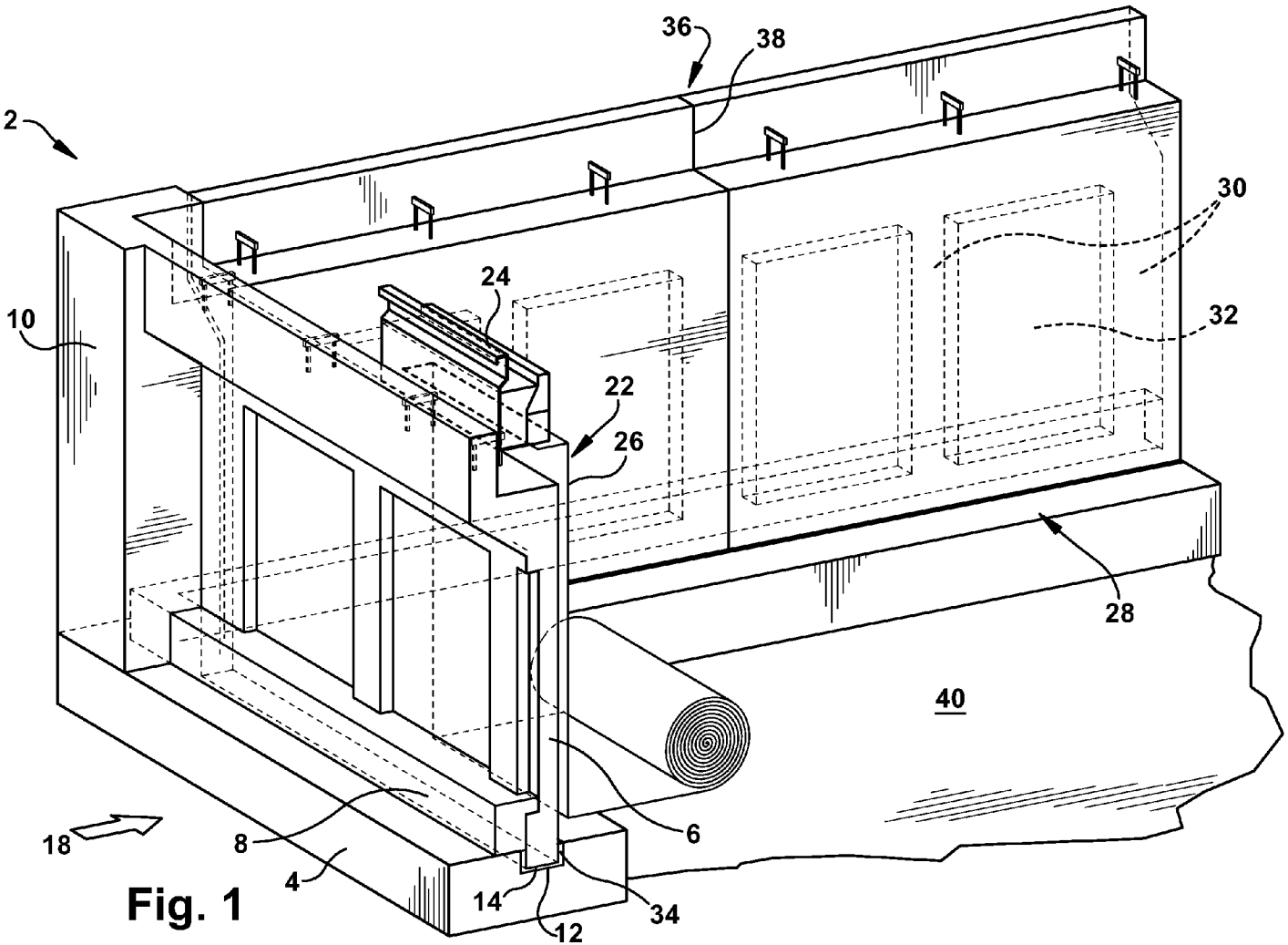
FIG. 1 is a partial perspective view of one embodiment of the invention including a concrete container.
Figure 2:
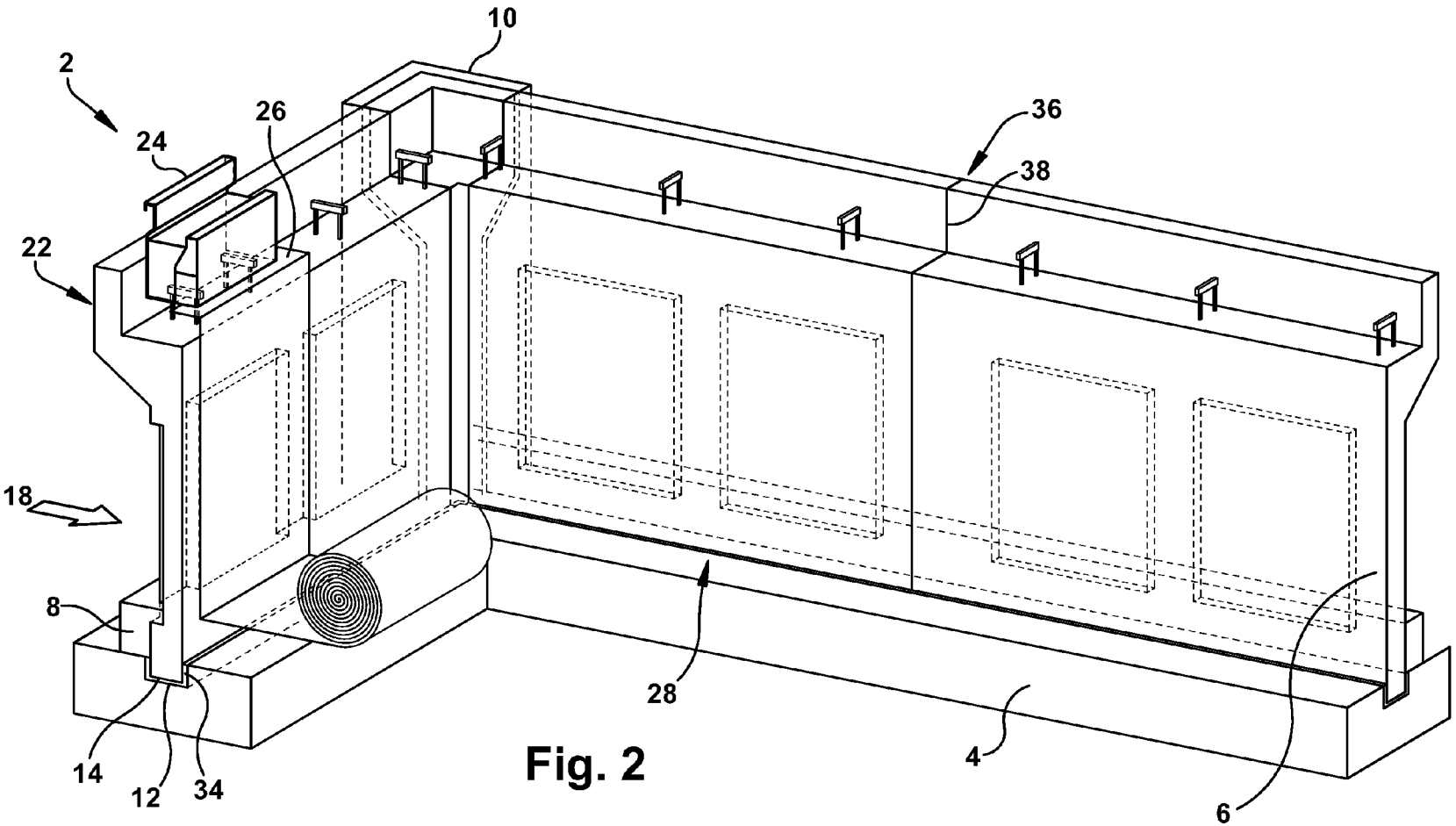
FIG. 2 is a partial perspective view of one embodiment of the invention including a concrete container.

Referring to FIGS. 1 and 2, embodiments of perspective partial views of a concrete container 2 are shown. Concrete container 2 may include a concrete footing 4, a concrete wall 6, a concrete moment connection 8, and a concrete corner closure 10. Concrete footing 4 may be substantially rectangular in shape and may include a shear key 12 for receiving concrete wall 6. Concrete wall 6 may be substantially rectangular with a bottom surface 14 for insertion in shear key 12. Concrete container 2 may include a concrete pool.

Figure 3:
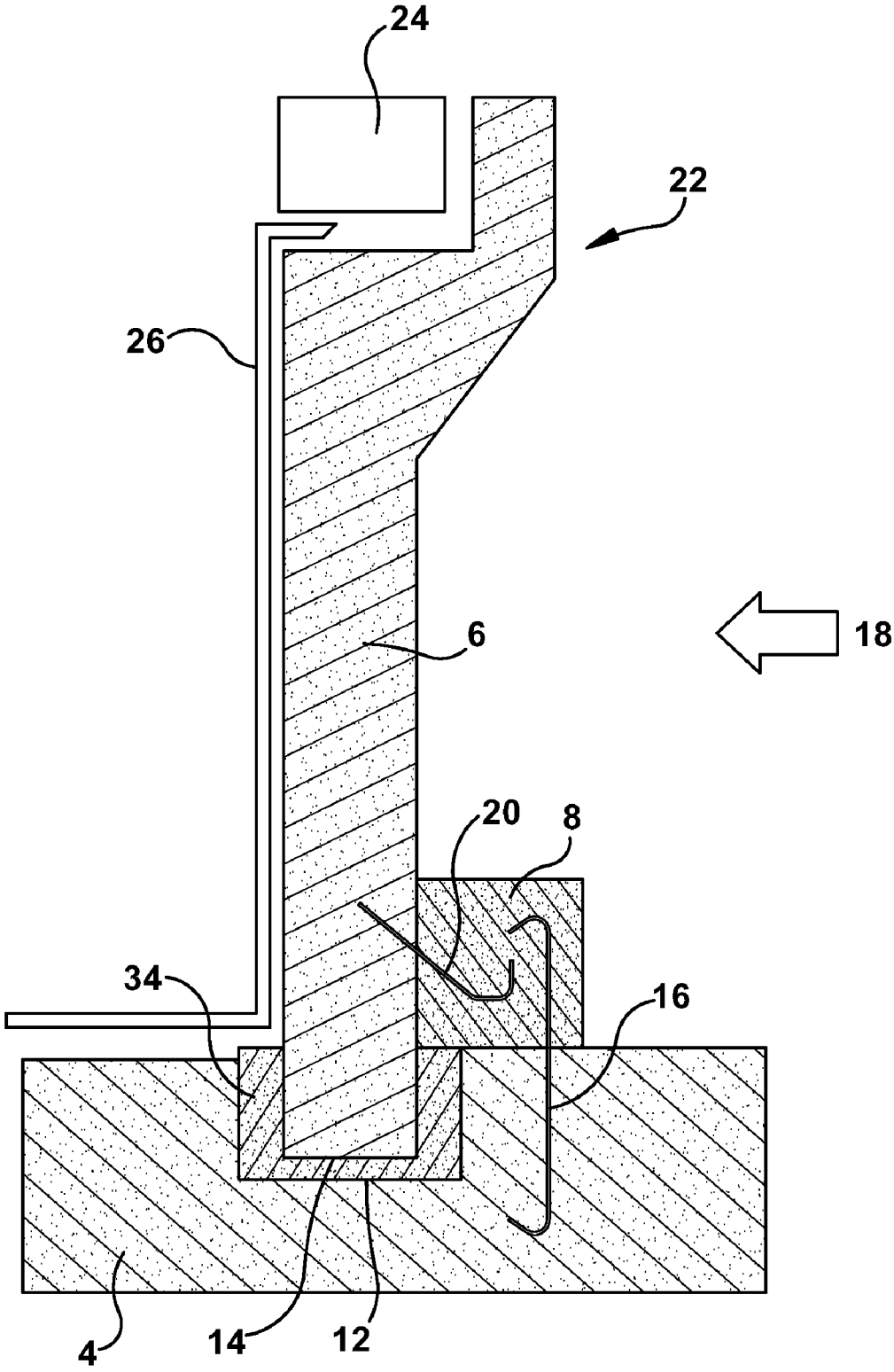
FIG. 3 is a cross-sectional view of one embodiment of the invention including a concrete wall, a footing, and a moment connection.

Referring to FIG. 3, one embodiment of an end view of concrete wall 6, concrete footing 4, and concrete moment connection 8 is shown. Concrete footing 4 may include a plurality of footing reinforcing members 16. Footing reinforcing members 16 may be inserted in the concrete footing 4 on a support side 18 of the shear key 12 and extending above the concrete footing 4. Support side 18 is the side of the concrete wall 6 opposite the direction of pressure being placed on the concrete wall 6. Support side 18 is shown in FIGS. 1, 2, and 3 on one side of concrete wall 6. However, a person skilled in the art will readily recognize that either side of concrete wall 6 may be support side 18 depending upon the circumstances of construction and use of concrete container 2. Concrete wall 6 may include a plurality of wall reinforcing members 20 inserted in the concrete wall 6 on support side 18 of concrete wall 6 and extending diagonally towards concrete footing 4. A concrete moment connection 8 substantially covers footing reinforcing members 16 extending from concrete footing 4 and wall reinforcing members 20 extending from concrete wall 6.

Concrete footing 4 may include pre-cast concrete footing segments, cast-in-place, or constructed in any other now known or to be developed manner. Similarly, concrete wall 6 may include pre-cast concrete wall segments, cast-in-place, or constructed in any other now known or to be developed manner. For a concrete pool, pre-cast concrete wall segments may be approximately 7.0' to 8.0' in height and approximately 18.0' to 21.0' in length.

Concrete wall 6 may be substantially planar. Concrete wall 6 is shown with a flare 22 at a top of concrete wall 6. Flare 22 may be shaped to receive a gutter system 24 and a liner 26. Flare 22 may also support a deck (not shown). Any now known or to be developed deck, gutter system 24 and liner 26 may be included. Flare 22 may be any shape that permits the installation of gutter system 24, liner 26, and deck. Referring again to FIGS. 1 and 2, one embodiment of concrete wall 6 may include a waffle design 28. Waffle design 28 includes at least two ribs 30 and at least one panel 32. Ribs 30 may be thicker than panels 32. For a concrete pool, each rib 30 may be approximately 8" in width and each panel 32 may be approximately 4" in width.

Footing reinforcing member 16 and wall reinforcing member 20 may include steel bar (i.e. "rebar"). Each footing reinforcing member 16 and each wall reinforcing member 20 may be inserted at various intervals in the concrete footing 4 and concrete wall 6 respectively. For a concrete pool, each footing reinforcing member 16 and each wall reinforcing member 20 may be inserted approximately once every foot on center. A person skilled in the art will readily recognize that footing and wall reinforcing members 16, 20 may be placed at closer or further intervals depending upon the degree of reinforcement desired. Alternatively, for concrete wall 6 with waffle design 28 each wall reinforcing member 20 may be inserted at rib 30. A plurality of wall reinforcing members 20 may be included at each rib 30 depending upon the amount of reinforcement desired. Footing reinforcing member 16 and wall reinforcing member 20 may be cast-in-place or inserted after casting. Inserted after casting may include, for example, screwing reinforcing member 16, 20 into concrete footing 4 or concrete wall 6. A person skilled in the art will readily recognize that footing reinforcing member 16 and wall reinforcing member 20 may be curved, straight, or any other shape. Footing reinforcing member 16 and wall reinforcing member 20 may extend out of concrete footing 4 and concrete wall 6 respectively. The extending of footing reinforcing member 16 may be substantially vertical. The extending of wall reinforcing member 20 may be substantially at a diagonal towards concrete footing 4. A person skilled in the art will readily recognize that reinforcement between moment connection and concrete footing and concrete wall may include a number of known and to be developed methods.

In one embodiment of invention, shear key 12 may include grouting 34. Grouting 34 may substantially fill space in the shear key 12 after concrete wall 6 has been inserted in shear key 12.

Concrete moment connection 8 may include poured concrete. Concrete moment connection 8 may substantially cover the portions of footing reinforcing member 16 extending from concrete footing 4 and wall reinforcing member 20 extending from concrete wall 6. Concrete moment connection 8 may include various shapes depending upon the forms used for pouring and the surfaces that concrete moment connection 8 is conforming to when poured. For a concrete pool, concrete moment connection 8 may be approximately the same length as concrete wall 6. For a concrete pool, concrete moment connection 8 may have width and depth of approximately 1.0' to 1.0'.

Figure 4:
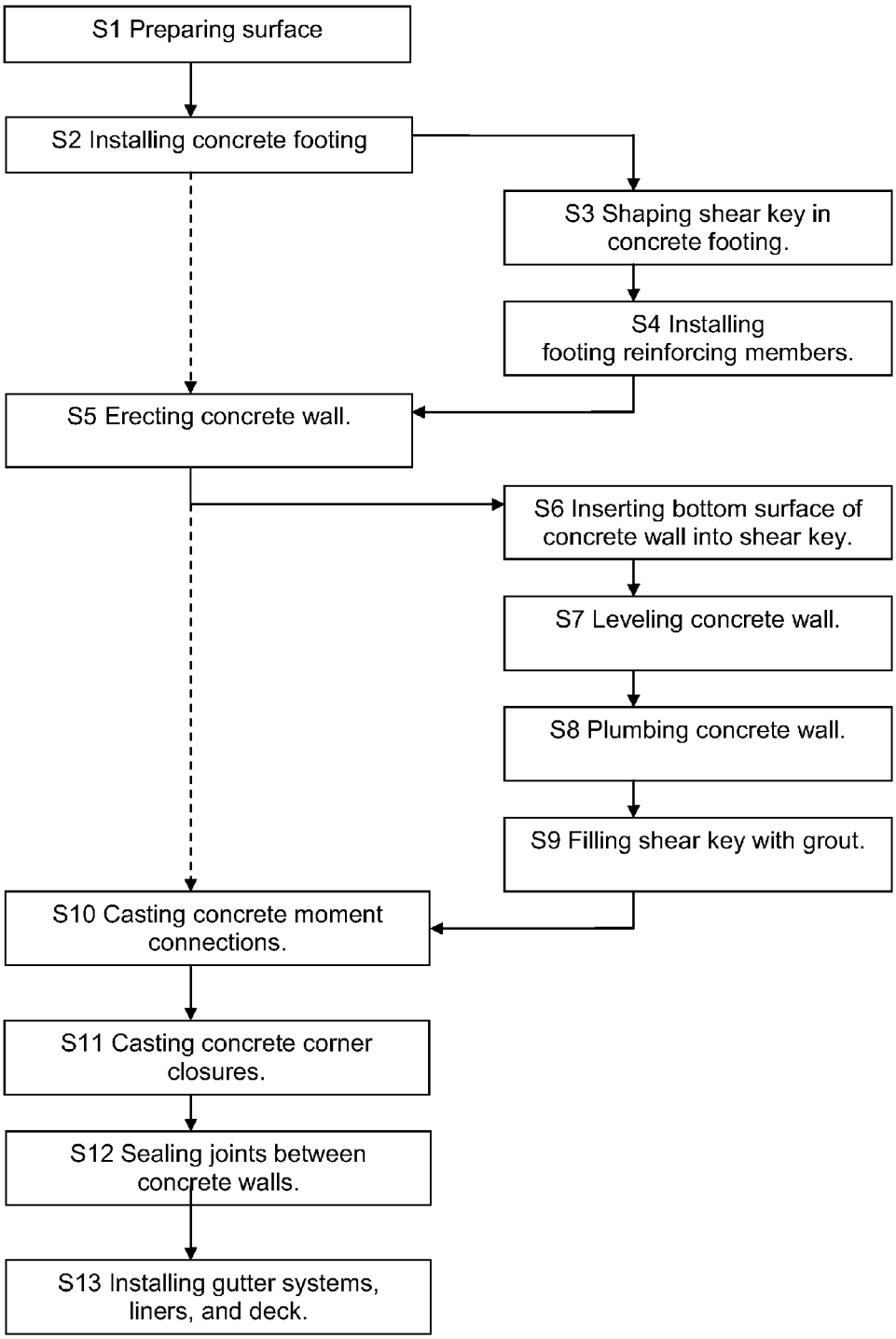
FIG. 4 is a flow diagram of a method for installing a concrete pool according to one embodiment of the invention.

Referring to FIG. 4, a flow diagram of a method for installing a concrete pool according to one embodiment of the invention is shown. Initially a surface 40 (FIG. 1) is prepared for installing the concrete pool at S1. Surface 40 may include a ground surface. Preparing surface 40 may include excavating and grading. A person skilled in the art will readily recognize many options for preparing surface 40 for installing the concrete pool. After surface 40 is prepared, concrete footing 4 (FIG. 1) may be installed on surface 40 at S2. Installing concrete footing 4 may include cast-in-place and installing pre-cast segments of concrete footing 4. Installing concrete footing 4 may include shaping a shear key 12 (FIG. 1) in concrete footing 4 on a side opposite surface 40 at S3. Installing concrete footing 4 may also include casting-in-place a plurality of footing reinforcing members 16 (FIG. 3) in the concrete footing 4 on support side of shear key 12 and extending above the concrete footing 4 as described herein at S4. A plurality of concrete walls 6 (FIG. 1) are erected at S5. Erecting concrete walls 6 may include erecting pre-cast wall segments. Erecting concrete walls 6 includes inserting a bottom surface 14 (FIG. 1) of the concrete wall 6 in shear key 12 at S6. Concrete wall 6 may include a plurality of wall reinforcing members 16 inserted in concrete wall 6 on support side 18 (FIG. 3) of concrete wall 6 and extending out of the concrete footing 4. Extending out of the concrete footing 4 may be in a diagonal direction towards surface 40. Concrete wall 6 may be leveled and plumbed at S7 and S8. Shear key 12 is substantially filled with grout 34 (FIG. 1) after concrete wall 6 is erected at S9. Moment connection 8 (FIG. 1) may be cast using poured concrete at S10. Pouring concrete may substantially cover the plurality of footing reinforcing members 16 (FIG. 3) extending from the concrete footing 4 and the plurality of wall reinforcing members 20 (FIG. 3) extending from the concrete wall 6. The concrete pool may include casting at least three concrete corner closures 8 using poured concrete at S11. Each corner closure 8 connects at least two adjacent concrete walls 6.

Preparing concrete footing 4 may include pre-cast and casting-in-place. For a concrete pool, each pre-cast concrete wall segment is approximately 7.0' to 8.0' in height and approximately 18.0' to 21.0' in length. For a concrete pool, concrete moment connection 8 may be approximately 1.0' by 1.0.' A joint 36 (FIG. 1) formed where two pre-cast concrete walls meet end to end may be sealed using a sealant 38 (FIG. 1) at S12. After concrete footing 4, concrete wall 6, and concrete corner closures 8 are in place liner 26 (FIG. 1), gutter system 24 (FIG. 1), and deck may be installed using any now known or to be developed methods of installation S13.

As used herein, an element or step recited in the singular and proceeded with the word "a" or "an" should be understood as not excluding plural elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The foregoing description of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

What is claimed is:

1. A concrete container, comprising:

a concrete footing including a shear key;

a concrete wall inserted in the included shear key;

a plurality of footing reinforcing members, each footing reinforcing member inserted in the concrete footing on a support side of the included shear key and extending above the concrete footing;

a plurality of wall reinforcing members having a first end and a second end, each wall reinforcing member inserted in the concrete wall on a support side of the concrete wall and extending diagonally towards the concrete footing, wherein the first end is inserted in the concrete wall and the second end is embedded in a concrete moment connection; and the concrete moment connection having a rectangular shape substantially covering each of the plurality of footing reinforcing members extending from the concrete footing and substantially covering each of the plurality of wall reinforcing members extending from the wall, wherein the concrete moment connection directly contacts the concrete footing and it does not extend beyond an outer edge of the concrete footing.

2. The concrete container of claim 1, wherein at least one of the concrete footing and concrete wall include pre-cast concrete.

3. The concrete container of claim 1, wherein the shear key contains grouting.

4. The concrete container of claim 1, wherein each footing reinforcing member is inserted approximately once every foot on center.

5. The concrete container of claim 1, wherein the concrete wall includes a plurality of pre-cast concrete wall segments.

6. The concrete container of claim 1, wherein the concrete footing includes a plurality of pre-cast concrete footing segments.

7. The concrete container of claim 1, wherein the reinforcing members inserted is one of screwed in and cast-in-place.

8. A concrete pool, comprising:

a concrete footing including a shear key;

a concrete wall inserted in the included shear key;

a plurality of footing reinforcing members, each footing reinforcing member inserted in the concrete footing on a support side of the included shear key and extending above the concrete footing;

a plurality of wall reinforcing members having a first end and a second end, each wall reinforcing member inserted in the concrete wall on a support side of the concrete wall and extending diagonally towards the concrete footing, wherein the first end is inserted in the concrete wall and the second end is embedded in a poured concrete moment connection; and the poured concrete moment connection having a rectangular shape substantially covering each of the plurality of footing reinforcing members extending from the concrete footing and substantially covering each of the plurality of wall reinforcing members extending from the wall, wherein the concrete moment connection directly contacts the concrete footing and it does not extend beyond an outer edge of the concrete footing.

9. The concrete pool of claim 8, wherein at least one of the concrete footing and concrete wall include pre-cast concrete.

10. The concrete pool of claim 8, wherein the shear key contains grouting.

11. The concrete pool of claim 8, wherein the plurality of footing reinforcing members are inserted approximately one every foot on center.

12. The concrete pool of claim 8, wherein the concrete wall includes a plurality of pre-cast concrete wall segments.

13. The concrete pool of claim 8, wherein the concrete footing includes a plurality of pre-cast concrete footing segments.

14. The concrete pool of claim 8, wherein each pre-cast concrete wall segment is approximately 7.0' to 8.0' in height and approximately 18.0' to 21.0' in length.

15. A method for installing a concrete pool, the method comprising:

installing a concrete footing on a surface, wherein the preparing includes:

shaping a shear key in the footing on a side opposite the surface; and casting-in-place a plurality of footing reinforcing members, each footing reinforcing member inserted in the footing on a support side of the included shear key and extending above the concrete footing;

installing a concrete wall, wherein a bottom surface of the concrete wall is inserted in the included shear key and wherein the concrete wall includes a plurality of wall reinforcing members having a first end and a second end, each wall reinforcing member inserted in the concrete wall on a support side of the concrete wall and extending diagonally towards the concrete footing, wherein the first end is inserted in the concrete wall;

leveling the concrete wall;

plumbing the concrete wall;

substantially filling the shear key with a grout;

casting a concrete moment connection having a rectangular shape substantially covering each of the plurality of footing reinforcing members extending from the concrete footing and substantially covering each of the plurality of wall reinforcing members extending from the concrete wall, wherein the second end is embedded in the concrete moment connection, and wherein the concrete moment connection directly contacts the concrete footing and it does not extend beyond an outer edge of the concrete footing; and casting at least three concrete corner closures, wherein each concrete corner closure connects two adjacent concrete walls.

16. The method of claim 15, wherein the installing a concrete footing includes pre-cast and casting-in-place.

17. The method of claim 15, wherein concrete wall includes a plurality of pre-cast wall segments, each pre-cast wall segment approximately 7.0' to 8.0' in height and approximately 18.0' to 21.0' in length.

18. The method of claim 16, wherein the concrete moment connection is approximately 1.0' by 1.0'.

19. The method of claim 15 further comprising: sealing a joint with sealant, where the joint is formed where two concrete walls meet end to end.

20. The method of claim 15 further comprising: installing a liner and a gutter system.

* * * * *